US007748508B2

(12) United States Patent
Lee et al.

(10) Patent No.: US 7,748,508 B2
(45) Date of Patent: Jul. 6, 2010

(54) WHEELED LUGGAGE CASE

(75) Inventors: Paul Tee Hui Lee, 15 Powys Avenue, Leicester, LE2 2DQ (GB); Marc Tee Huang Lee, Apt. 12-01, Block B, Elizabeth Towers, 12 Mount Elizabeth, Singapore (SG)

(73) Assignees: Paul Tee Hui Lee, Leicester (GB); Marc Tee Huang Lee, Elizabeth Towers (SG); Bianca Muthesius, Leicester (GB); Tom Siang Eng Lee, Elizabeth Towers (SG)

( * ) Notice: Subject to any disclaimer, the term of this patent is extended or adjusted under 35 U.S.C. 154(b) by 126 days.

(21) Appl. No.: 10/587,415

(22) PCT Filed: Feb. 28, 2005

(86) PCT No.: PCT/GB2005/000749

§ 371 (c)(1),
(2), (4) Date: Jul. 27, 2006

(87) PCT Pub. No.: WO2005/084481

PCT Pub. Date: Sep. 15, 2005

(65) Prior Publication Data

US 2008/0000742 A1 Jan. 3, 2008

(30) Foreign Application Priority Data

Feb. 28, 2004 (GB) ..... 0404464.0

(51) Int. Cl.
*A45C 5/00* (2006.01)

(52) U.S. Cl. ..... 190/18 A; 190/115; 280/37; 280/47.371; 280/655

(58) Field of Classification Search ..... 190/18 A, 190/115; 280/37, 47.371, 47.375, 655
See application file for complete search history.

(56) References Cited

U.S. PATENT DOCUMENTS 2,002,836 A 5/1935 Rossi (Continued)

FOREIGN PATENT DOCUMENTS

| | | | |
|---|---|---|---|
| FR | 968949 A | | 12/1950 |
| FR | 968.949 | | 12/1980 |
| FR | 2598897 | * | 8/1986 |
| GB | 2 124 589 A | | 2/1984 |
| GB | 2124589 A | | 2/1984 |

OTHER PUBLICATIONS

Coniglio, C; International Search Report PCT/GB2005/000749; Jun. 27, 2005; 3 pages; Netherland, Rijswijk.

(Continued)

*Primary Examiner*—Tri M Mai
(74) *Attorney, Agent, or Firm*—Andrus, Sceales, Starke & Sawall, LLP

(57) ABSTRACT

The present invention provides a wheeled luggage case having a luggage receptacle, the receptacle having a bottom wall, a top wall, opposed end walls and opposed side walls forming a luggage compartment, wherein said luggage case further comprises:—(I) a plurality of support wheels located at one end of the bottom wall; (II) a retractable steering wheel assembly or assemblies, located on the bottom wall, distanced from the support wheels, said steering wheel assembly being moveable between an active position in which the wheel assembly extends below the bottom wall of the luggage receptacle and an inactive position in which the wheel assembly is substantially within the profile of the luggage receptacle; (III) a handle means located at one end of the luggage receptacle for steering, pushing, pulling and lifting purposes wherein when the steering wheel assembly is in an active position the base wall forms an acute angle with respect to the ground.

21 Claims, 16 Drawing Sheets

U.S. PATENT DOCUMENTS

| | | | | | |
|---|---|---|---|---|---|
| 4,228,877 | A | | 10/1980 | Cothary | |
| 4,261,447 | A | * | 4/1981 | Arias et al. | 190/18 A |
| 4,717,168 | A | * | 1/1988 | Moon, Sr. | 280/641 |
| 4,890,705 | A | * | 1/1990 | Pineda | 190/18 A |
| 5,044,476 | A | * | 9/1991 | Seynhaeve | 190/18 A |
| 5,249,438 | A | | 10/1993 | Rhaney | |
| 5,407,039 | A | * | 4/1995 | Alper et al. | 190/18 A |
| 5,873,439 | A | | 2/1999 | Liang | |
| 6,082,510 | A | | 7/2000 | Liang | |
| 6,182,981 | B1 | * | 2/2001 | Kuo | 280/37 |
| 6,193,033 | B1 | * | 2/2001 | Sadow et al. | 190/18 A |
| 6,241,313 | B1 | * | 6/2001 | Lenz et al. | 297/217.1 |
| 7,051,853 | B2 | * | 5/2006 | Brown | 190/18 A |

OTHER PUBLICATIONS

Conniglio, C; International Search Report PCT/GB2005/000749; Jun. 27, 2005; 3 Pages; Form PCT/ISA210 (Patent Family Annex); Netherlands.

Chinese Patent Office, "Report of First Office Action" for CN Pat. Appln. No. 200580006314.1, mailing date of May 9, 2008.

English Translation of Chomard FR2598897, obtained from esp2cenet.com, Jul. 9, 2009.

* cited by examiner

WHEELED LUGGAGE CASE

FIELD OF THE INVENTION

This invention relates to traveller's luggage cases and more particularly to luggage cases which are equipped with wheels and a push-handle to facilitate movement of the case along a floor, walkway or the like.

BACKGROUND OF THE INVENTION

During the past few decades, people have been travelling over longer distances for longer periods, carrying with them larger and heavier suitcases. Lifting and manually carrying luggage at airports, railway stations, hotels or other sites is a task which is generally disliked by travelers.

Rental luggage carts are available at certain sites of this kind but the renting process is itself an inconvenience and such carts do not remain with the traveller after leaving the site of rental.

In order to mitigate this problem, wheeled luggage carriers which typically have a lightweight and foldable construction to facilitate handling and storage of the device when it is not in use, have been used. An example of such a carrier is shown in FIG. 1.

Such carriers are essentially small hand trucks of the type which have a platform on which the luggage case is rested, a pair of wheels which extend below one edge region of the platform and a handle which extends upward from the edge region. The user grasps and tilts the handle to lift the platform and luggage case upward from the underlying floor or the like and the carrier may then be pulled or pushed to the destination of the case. Such carriers are helpful but are not entirely free of inconveniences of their own.

The carrier is not self-stabilized and it is not entirely self-supporting during movement. A person who is pulling or pushing such a carrier must continually exert additional effort in order to hold the carrier at the tilted orientation that enables it to be travelled along the floor or other surface. In the absence of such effort by the user, gravity pivots the carrier until either the platform or the handle itself contacts the floor.

When the luggage case is removed from the carrier the carrier itself becomes essentially still another separate piece of luggage which the traveller must contend with.

The instability of such a carrier when it is tilted to the travelling orientation and the pivoting movement which occurs when the handle is released make it unsatisfactory for certain purposes such as for transporting a small child along with a luggage case.

Efforts have been made to make the luggage case itself wheelable without the aid of a separate carrier. This typically consists of providing wheels at the surface of the case that faces downward when the case is in an upright position.

Most case designs have wheels placed at the opposing corners of a narrow side of a conventional rectangular box-type suitcase. When in this orientation, in which the case can be wheeled along, the case is substantially higher than it is wide. An example of this type of case can be seen in FIG. 2.

The advantages of this arrangement are ease of changing between carrying and rolling the suitcase and rolling the suitcase by one's side without obstruction to walking. However the significant disadvantages are difficulty in manoeuvrability due to a long narrow base, instability due to the narrow base and a high centre of gravity and the person pulling such a case generally has to lean over into an awkward posture.

After wheels are attached to suitcases making them 'more portable', further innovations were aimed at optimising ergonomics, case material and case design for wheeling and manoeuvrability efficiency.

Retractable handles were built into wheeled luggage cases to facilitate movement of the case as shown in FIG. 3. When the handle is extended, the unit may be tilted about the wheels and be operated in essentially the same manner as the previously discussed luggage case carriers.

The advantages of such a design are a retractable handle, better manoeuvrability and improved ergonomics. However, such a design is meant for small and light cases. Large size suitcases that have adopted such a design have been cumbersome and tiresome to take around due to their considerable size and weight and are subject to all of the limitations of the prior carriers.

In all of the previous designs the narrow base and high centre of gravity meant that the cases were unstable.

Back in the 1980's, some tried to attach wheels to the broad side of the suitcase where the surface was widest and push (or pull) the case lying on this widest side on the wheels like a trolley (see prior U.S. Pat. No. 6,041,900 Outerrigger Inc.). This provided better stability with a wide base and low centre of gravity. However, this idea had never taken-off as there are several disadvantages inherent in the design. For example, there are practical inconveniences with potential damage to the exposed wheels during transfer/storage and in packing and unpacking with a non-stationary suitcase.

People have tried to make the wheels retractable and generally use a holding mechanism, for example a catch or latch, in order to hold the wheel in its extended position during use. An example of this is shown in U.S. Pat. No. 5,407,039 Alper, Brad and Trevethick, Richard. The multiple retractable wheels are flimsy, cumbersome and inconvenient to activate and retract. Moreover, they make the whole case too heavy for practical purposes.

In addition, the holding mechanisms are not always able to support the weight of the often heavy luggage for prolonged use which results in failure of the holding mechanism and luggage of this type will often have to be repaired or replaced on a regular basis.

There has been a long felt want for luggage which is (1) easily manoeuvrable with good stability and ergonomics and (2) convenient and practical for use. The present invention is directed to overcoming one or more of the problems discussed above.

SUMMARY OF THE INVENTION

According to a first aspect of the present invention there is provided a wheeled luggage case having a luggage receptacle, the receptacle having two opposing major walls and having end walls forming a luggage compartment, whereof a major wall of the receptacle is adapted to serve as a bottom wall that faces the ground during use of the wheels, wherein said luggage case further comprises:

(i) a plurality of support wheels located at one end of the bottom wall;

(ii) a retractable steering wheel assembly, located on the bottom wall, distanced from the support wheels, said steering wheel assembly having at least one wheel and being moveable between an active position at which the wheel assembly extends below the bottom wall of the luggage receptacle or an inactive position at which the wheel assembly is substantially within the profile of the luggage receptacle; and (iii) a handle means located at one end of the luggage receptacle for steering, pushing, pulling and lifting purposes; the steering wheel assembly and support wheels being configured such that with the steering wheel assembly in its active position, the base wall forms an acute angle with respect to the ground, the acute angle extending away from the support wheels.

The opposing major walls of the case are the opposing walls of the case that are of largest surface area. Suitably the handle means is located at the same end of the luggage receptacle as the support wheels.

Preferably the steering wheel assembly, in the active position, extends further from the base wall than the support wheels. This arrangement whereby the luggage receptacle is tilted back towards the support wheels displaces the centre of gravity towards the user pushing the case and makes it easier to push. This arrangement also displaces the centre of gravity away from the steering wheels, thus off-loading it and making it easier to steer.

Preferably the wheeled luggage comprises two support wheels and one retractable steering wheel assembly in a tricycle wheel configuration. This tricycle configuration confers additional manoeuvrability with good stability while minimising total luggage weight and optimising ease and convenience of operating the wheeling system.

This arrangement optimises manoeuvrability with good stability while minimising total luggage weight and optimising ease and convenience of operating the wheeling system.

The support wheels are only 'activated' when steering wheel(s) is extended and tilts the case backwards. This arrangement optimises the ease and convenience of activating and inactivating the wheeling system and minimising the weight of wheeling system.

Preferably the retractable wheel assembly is pivotally mounted or mounted in a slotted fashion.

Preferably the luggage receptacle incorporates recesses in both the end wall and the bottom wall adapted to accommodate the steering wheel assembly in the inactive and active positions respectively.

Preferably the wheel of the steering wheel assembly is pivotally mounted in the assembly such that it can rotate about its own axis and about an axis substantially perpendicular to it. This arrangement facilitates steering.

Preferably the steering wheel assembly, when in an active position, is supported by a support surface on the base wall of the case.

Preferably the support surface is recessed into the base wall of the case.

In a particularly preferred embodiment the support surface for the wheel assembly in the base wall is located at an acute angle to the base wall of the case with respect to a line between the front of the case and the support wheels so that the support surface is about parallel to the ground surface. This arrangement has the advantage that the forces acting on the steering wheel assembly are dissipated through the support surface to the base of the case in compression rather than through point loading at the pivot means about which the steering wheel assembly is mounted.

In a further preferred embodiment the steering wheel assembly and support wheels are so sized and shaped such that, with the steering wheel assembly in its active position, the base wall forms an acute angle with respect to the surface the case is standing on, the acute angle extending away from the support wheels. This arrangement displaces the centre of gravity of the case contents toward the support wheels and towards the handle and the user. This makes the case easier to push the load. At the same time, this arrangement displaces the centre of gravity of the case contents away from the steering wheel to offload it and makes it easier to steer the case.

Preferably, when the steering wheel is retracted in an inactive position, the broad base of the case is parallel to the supporting ground on a 'stopper' at one end of the case base and on support wheels on the other end. When the front steering wheel in extended in the active position, it tilts the case and automatically 'activates' the rear support wheels into play.

This arrangement whereby the luggage receptacle is tilted back towards the support wheels displaces the centre of gravity towards the user pushing the case and makes it easier to push.

This arrangement whereby the luggage receptacle is tilted back towards the support wheels displaces the centre of gravity away from the steering wheel(s) and makes it easier to steer.

This arrangement whereby the luggage receptacle is tilted backwards enables the retractable handle to tilt backwards away from the posterior surface of the luggage receptacle to allow for striding space.

This arrangement whereby the luggage receptacle is tilted backwards renders other luggage carried on top of the case less likely to fall off.

This arrangement whereby the luggage receptacle is tilted backwards enables the case to be converted to a push pram with safety and accessorial attachment.

Preferably the handle means can be moved between an active position at which the handle extends outwards from the luggage receptacle and can be engaged by the user at an inactive position at which the handle is contained substantially within the luggage receptacle. When the steering wheel and handle are retracted, the luggage case can be carried by a handle placed at the long narrow surface like an ordinary carrying case.

Preferably, when the wheeling system is activated and the case tilted backwards, the handle is also tilted backwards away from the posterior case surface to allow for sufficient striding space. Preferably, the posterior surface of the case is optionally recessed to provide additional striding space.

Preferably, the case is made of robust material not only for durability and protection of the contents, but to be able to provide a platform for carrying other pieces of luggage stacked on top of it. When the steering wheel and handle are in their active positions, the case can act as a cart/trolley for carrying other pieces of luggage.

Preferably, the case can be conveniently converted into a push pram for babies or toddlers with suitable accessorial and safety attachment.

Preferably, a simple braking system is installed for safety and convenience purposes.

BRIEF DESCRIPTION OF THE DRAWINGS

The present invention will now be described by way of examples only with reference to the accompanying drawings wherein.

DESCRIPTION OF THE PREFERRED EMBODIMENTS

The present embodiments represent currently the best ways known to the applicant of putting the invention into practice. But they are not the only ways in which this can be achieved. They are illustrated, and they will now be described, by way of example only.

Figure 1:
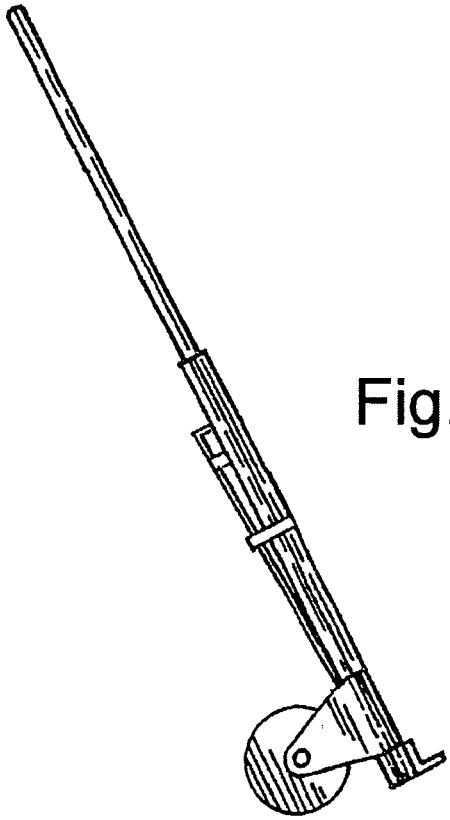
FIG. 1 illustrates a prior art wheeled luggage carrier.
Figure 2:
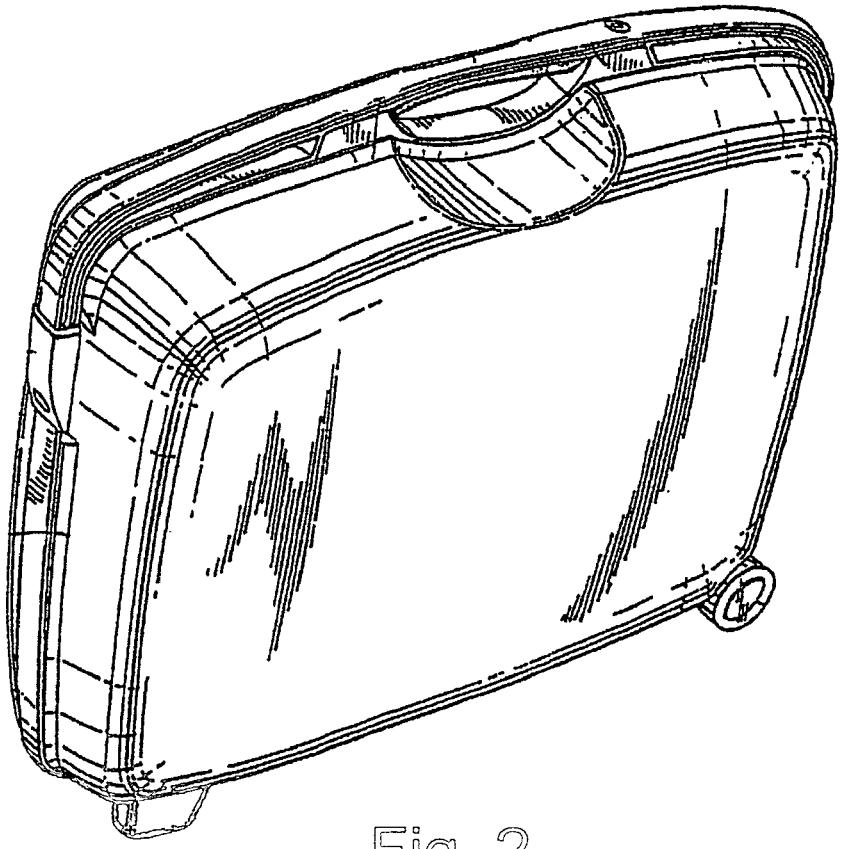
FIG. 2 illustrates a prior art wheeled luggage case.
Figure 3B:
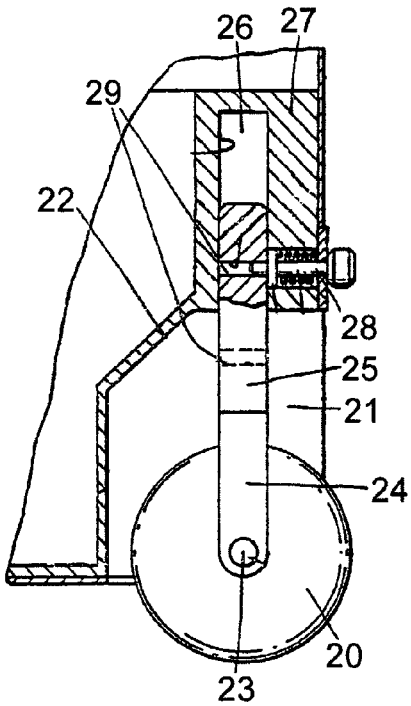
FIG. 3*b* illustrates a close up view of prior art retractable wheel.
Figure 3A:
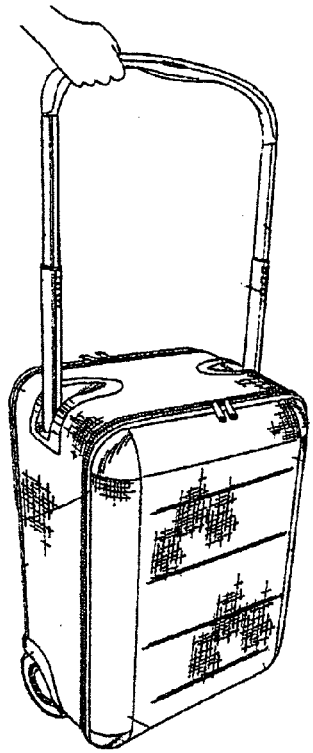
FIG. 3 *a* illustrates a prior art wheeled luggage case with handle.

FIGS. 1-3 show various prior art designs for mounting a luggage case on wheels. FIG. 1 shows a foldable frame upon which luggage would be placed to facilitate movement. FIG. 2 shows a case with wheels mounted at one end of a narrow edge surface. FIG. 3*a* shows an alternate wheel mounted case with a retractable handle to facilitate movement. All of these designs suffer from the various drawbacks above.

Few cases incorporate means for making the wheels retractable. There are obvious advantages to this, when not being wheeled the wheels can catch and snag on various articles. Also it is desirable to have a stationary receptacle when packing and unpacking.

An example of a typical retraction means is shown in FIG. 3*b*.

A wheel 20 is partially situated in an alcove 21 formed in the frame of the receptacle 22. The axle 23 of the wheel 20 engages a fork 24 having a shank 25 that extends up into a vertical passage 26 in a thickened portion of the frame 27. The shank and passage are of sufficient length to enable the raising of the wheel to the point where the lower edge of the wheel is above the level of the underside of the receptacle. To hold the wheel at either the raised or the lowered position, the retraction means includes a pin 28 which extends through a passage in the frame and which may be entered into either of a pair of bores 29 which corresponds with either the raised or lowered position. A compression spring acts against a flange to resist withdrawal of the pin.

The multiple retractable wheels along with the holding mechanisms are flimsy, cumbersome and inconvenient to activate and retract. More pertinently, they make the whole case too heavy for practical purposes.

Luggage cases often contain heavy loads and will be in use for long periods of time which puts large stresses onto the means holding the wheel in place. In the example in FIG. 3*b* all of the forces acting though the shank rests on the pin 28 holding the wheel in the lowered position. This generally results in failure of the holding mechanism after often unacceptably short periods of use.

Figure 4:
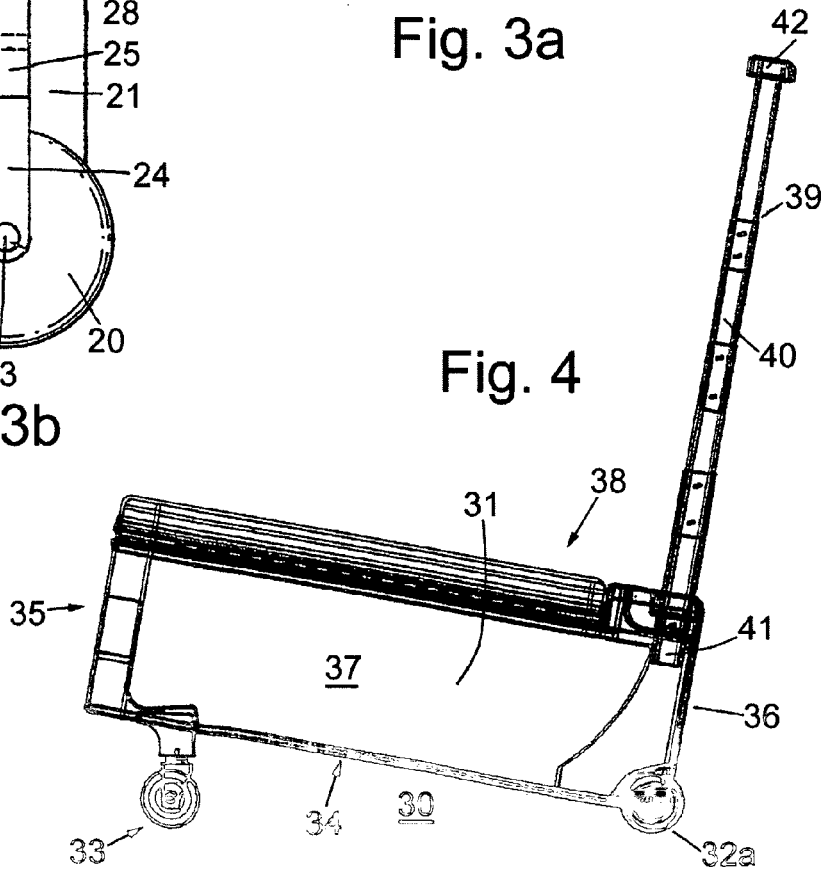
FIG. 4 illustrates a side view of a luggage case according to one embodiment of the present invention where the steering wheel and handle are in an active position.

FIGS. 4-10 shows a wheeled luggage case 30 according to one embodiment of the present invention. FIG. 4 shows a side view of a luggage case comprising a luggage receptacle 31, support wheel assemblies 32*a* (32*b* is not shown), a steering wheel assembly 33 and a retractable handle 39.

The luggage receptacle 31 is defined by a base 34, a front end wall 35, a rear end wall 36, a side wall 37 (the other side wall not shown) which forms a luggage compartment. The lid 38 spans the top of the compartment when the case is closed. Receptacle 31 and lid 38 may jointly have the general configuration and construction of a typical traveller's suitcase except for the specialised structural features which will be hereinafter described.

In this particular example, the receptacle 31 and lid 38 jointly have a generally rectangular configuration. Both such components are formed of a durable material. The case 30 may, of course, have other shapes and be formed of other materials and is equally adaptable to any sized luggage case.

It is preferred, although not essential in all cases, that the luggage receptacle 31 and lid 38 jointly have a length and a width which both exceed their height as this provides for maximum stability.

The lid can be fastened to the luggage receptacle by various means known to those skilled in the art and there are various ways in which the lid can be held closed including but not limited to zips, locks, clasps or any holding means.

While the case 30 is designed to be wheeled along a floor, walkway or the like, it is preferably provided with a conventional hand grip (not shown) to enable carrying of the case when it is being moved for only a short distance. The invention is equally adaptable to luggage cases which have other forms of hinges, closures, latching means and provisions for carrying the case.

A generally U-shaped retractable handle 39 enables the traveller to push the case 30 while walking in a normal upright posture. The handle has a pair of coplanar parallel arms 40 which can be retracted into a chamber 41 so that the top of the handle does not protrude beyond the lid 38 when not in use and does not interfere with storage of the case in restricted spaces. The opposite ends of the arms are linked by a cross member 42 which is grasped by the user during travel of the case. The handle 34 is extendible and contractible as each arm is formed by telescoping members. Means are provided to lock the arms in position during use which can optionally allow the traveller to select the degree of extension.

It should be understood that there are various ways in which the handle can be positioned during use and subsequently stored away when the case in not being used. For example, the handle could be formed from a generally U-shaped pivoting or folding handle. With contemporary light weight and tough materials the handle can easily be manufactured to various designs and the present invention encompasses any handle design.

Spaced apart support wheel assemblies 32*a* and 32*b* (not shown) are disposed at opposite side regions of the luggage receptacle 31 in proximity to the back end wall 36 of receptacle 31 and extend downward to contact the supporting surface. This can be seen more clearly in FIG. 8.

The inclination of the base of the case from the supporting surface tilts the handle bar backwards away from the posterior surface and postero-inferior edge of the case to provide striding space. A portion of the posterior surface of the case is optionally recessed to provide additional striding space (see drawing).

Figure 4A:
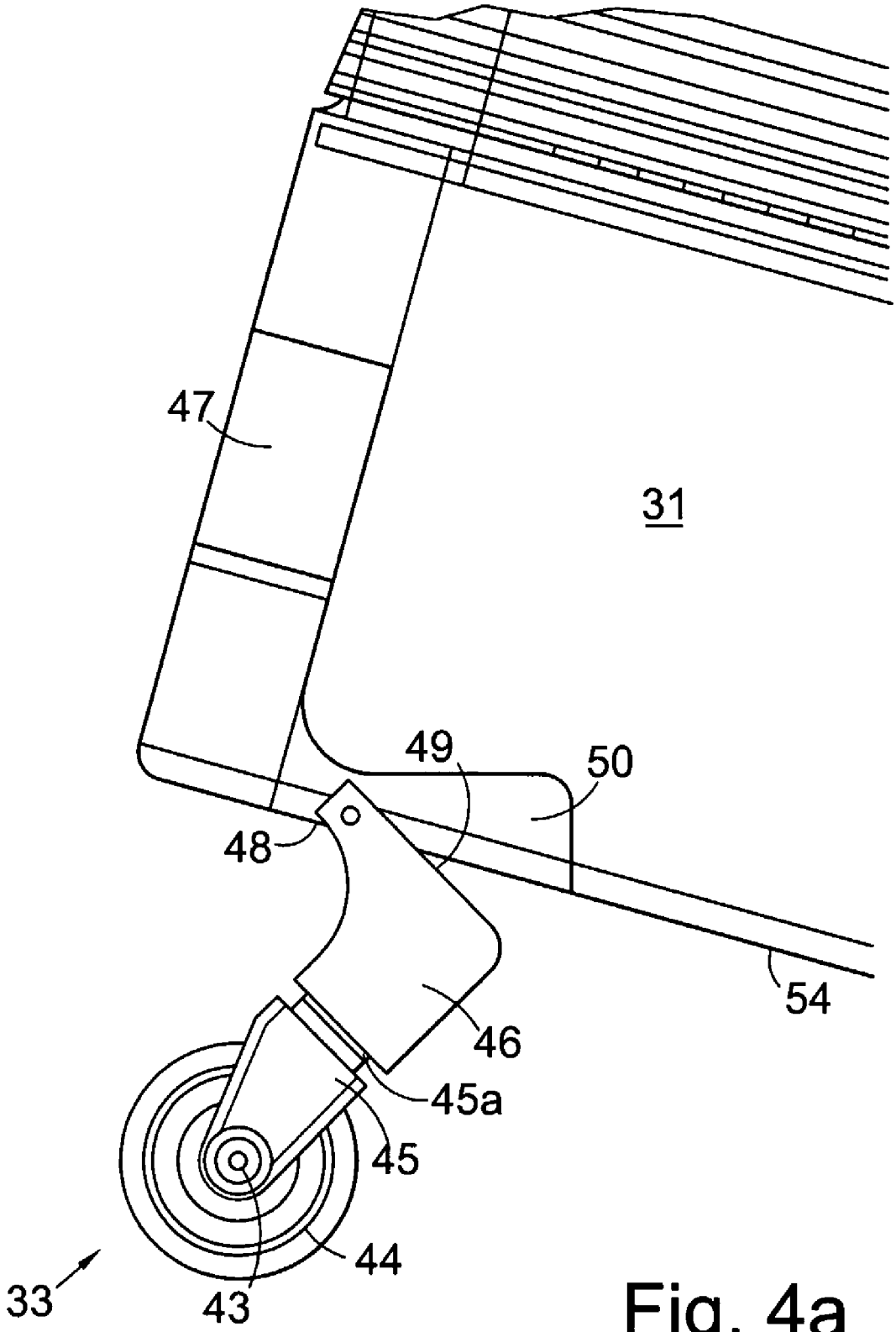
FIG. 4*a* illustrates a close up view of the steering wheel assembly.

A steering wheel assembly 33 is shown in FIG. 4 and a close up view of the steering wheel is shown in FIG. 4*a*. The axle 43 of the wheel 44 is connected to a holding bracket 45, which in turn is connected to a turning element 45*a* which can pivot about a substantially vertical axis in order to self adjust to turns in the path of the travel case. The turning element is connected to a pivotally mounted section 46 which allows the steering wheel to be moved between an active position in which the steering wheel assembly 33 extends below the bottom wall of the luggage receptacle 34 and an inactive position in which the steering wheel assembly is substantially contained within the luggage receptacle and does not protrude significantly beyond the front wall 35 and does not interfere with storage of the case in restricted spaces.

The luggage receptacle has a recess or opening 47 which is of sufficient size to receive the steering wheel assembly 33. In the example shown the wheel and turning element are in line during storage but any orientation could be used. The pivot 48 allows the pivotally mounting section to rotate between the active and inactive position. In the active position the top 49 of the pivotally mounting section 46 engages with a portion 50 of the support surface attached to the base 34 of the luggage receptacle 31. In this example the portion 50 is recessed slightly. Because the entire top of the pivotally mounting section engages with the support surface at the base of the luggage receptacle forces acting on the steering wheel assembly will pass through the turning element and pivotally mounting section and dissipate into the support surface and the luggage receptacle itself. This greatly reduces the stress on any one section of the steering wheel assembly and as such greatly increases its durability and strength.

One of the key features of the arrangement shown in FIG. 4*a* is the angle of the portion 50 with respect to the base of the case. Portion 50 is angled by some 15° in a line from the pivot point away from the base of the case and into the body of the case. A consequence of this design is that during forward motion of the case the load on the steering wheel assembly is taken mostly on the surface of portion 50 which is in contact with the steering wheel assembly, rather than being transmitted entirely through the pivot point, which is the case in earlier retractable wheel assembly designs.

The angle of portion 50 with respect to the base of the case is not critical. Any angle, for example 45°, could be used. Generally an angle of 15°±10° is preferred.

Surface 50 is orientated in a way, parallel or slight incline, to the surface on which the case is placed such that the forces acting on the activated steering wheel assembly is compressive and not bending, conferring extra strength to the assembly or the use of less material bulk (and weight) on the assembly to satisfactorily withstand practical loading stress. FIG. 4 shows that the steering wheel assembly 33 protrudes further from the base of the luggage receptacle than the support wheel assembly therefore when the steering wheel assembly is in an active position the luggage receptacle sits at an angle, the front end being higher than the back end which has a number of advantages. The angle means that a greater portion of the forces acting on the luggage receptacle will act though the support wheels, this has the effect that the luggage receptacle will appear lighter and will be easier to manoeuvre and steer through a fulcrum like effect. Secondly the angle means that if any articles are placed on top of the luggage receptacle they will naturally fall towards the handle which will mean that they will stay on top of the luggage receptacle more easily.

Figure 5:
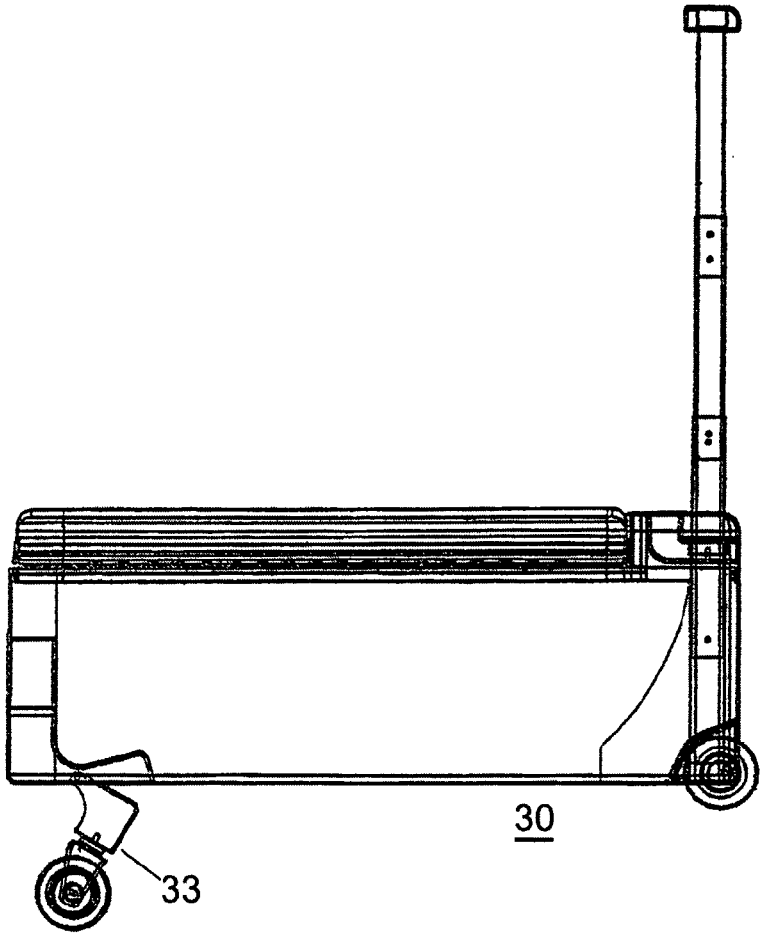
FIG. 5 illustrates a side view of the luggage case of FIG. 4 where the steering wheel assembly is moving towards an inactive position.

FIG. 5 shows the luggage receptacle wherein the steering wheel assembly 33 is in a partially inactive position.

Figure 6:
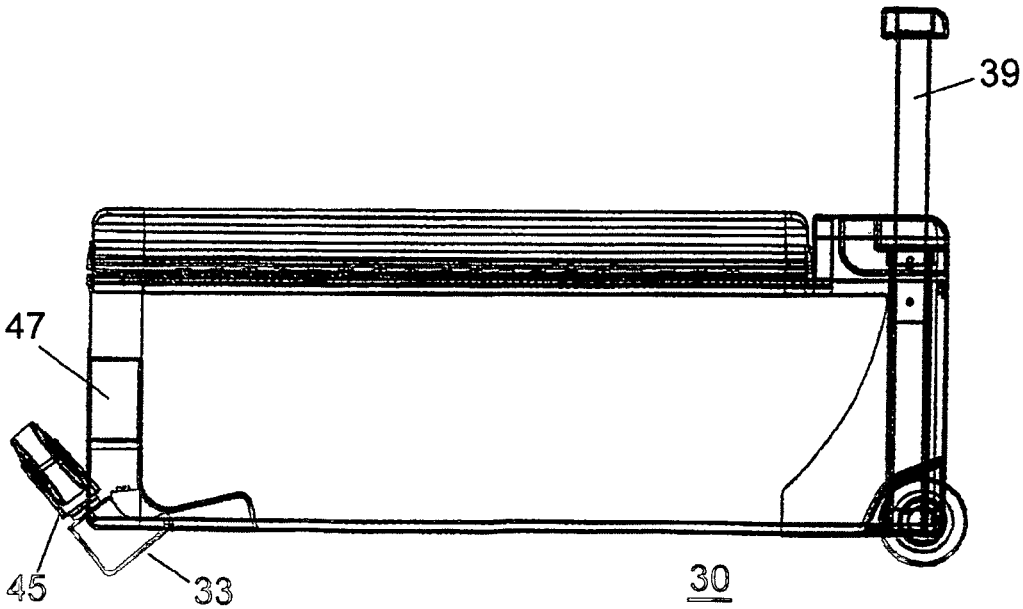
FIG. 6 shows a side view of the luggage case of FIG. 4 in between an active and inactive position.

FIG. 6 shows the luggage receptacle wherein the steering wheel assembly 33 is in an almost fully inactive position. The turning section 45 has been rotated perpendicularly to the direction of forward linear motion to facilitate complete retraction into the opening 47. The retractable handle 39 is in a semi-retracted or inactive position.

Figure 7:
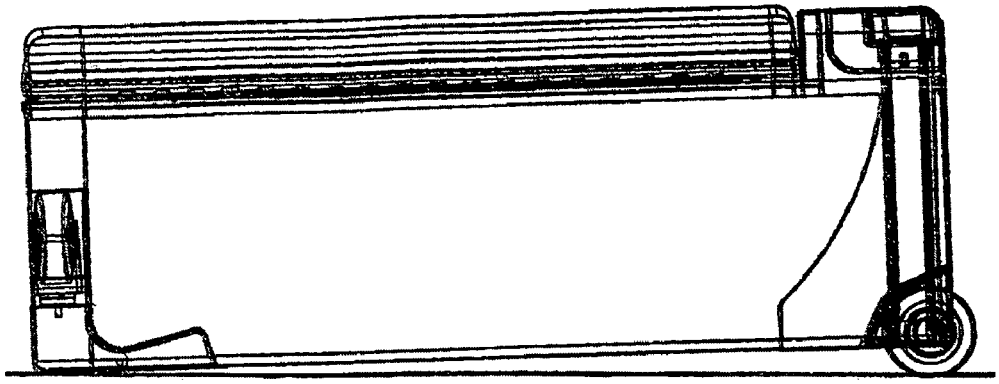
FIG. 7 shows a side view of the luggage case of FIG. 4 in an inactive position.
Figure 8:
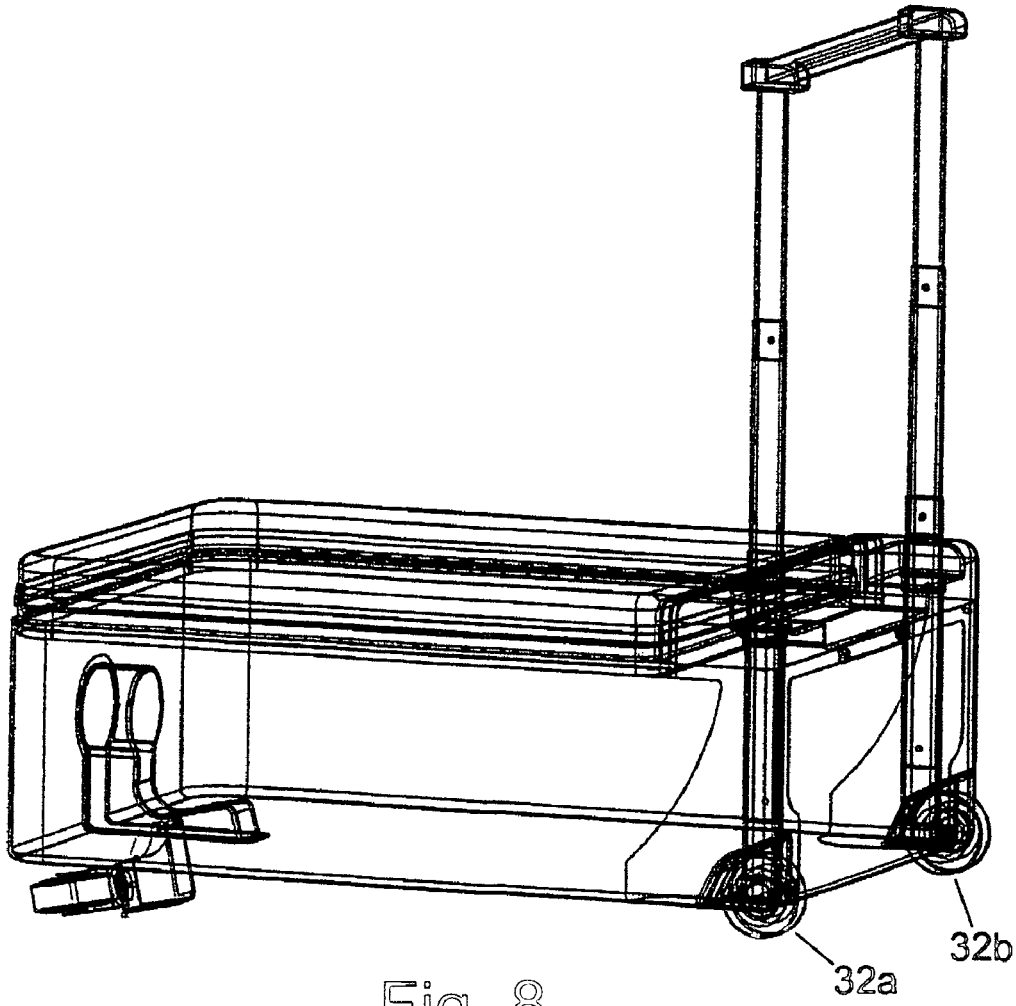
FIG. 8 shows a perspective view of the luggage case of the first embodiment.

FIG. 7 shows the steering wheel assembly 33 and the handle 39 in an inactive position. Neither substantially protrude beyond the surface of the luggage receptacle.

Figure 9:
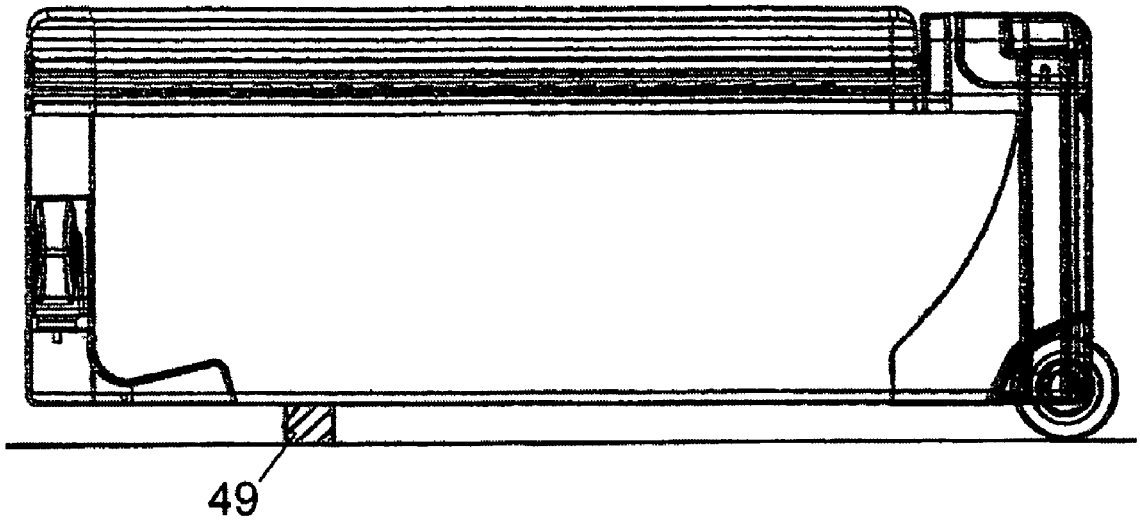
FIG. 9 illustrates a slightly different embodiment of the invention.
Figure 10:
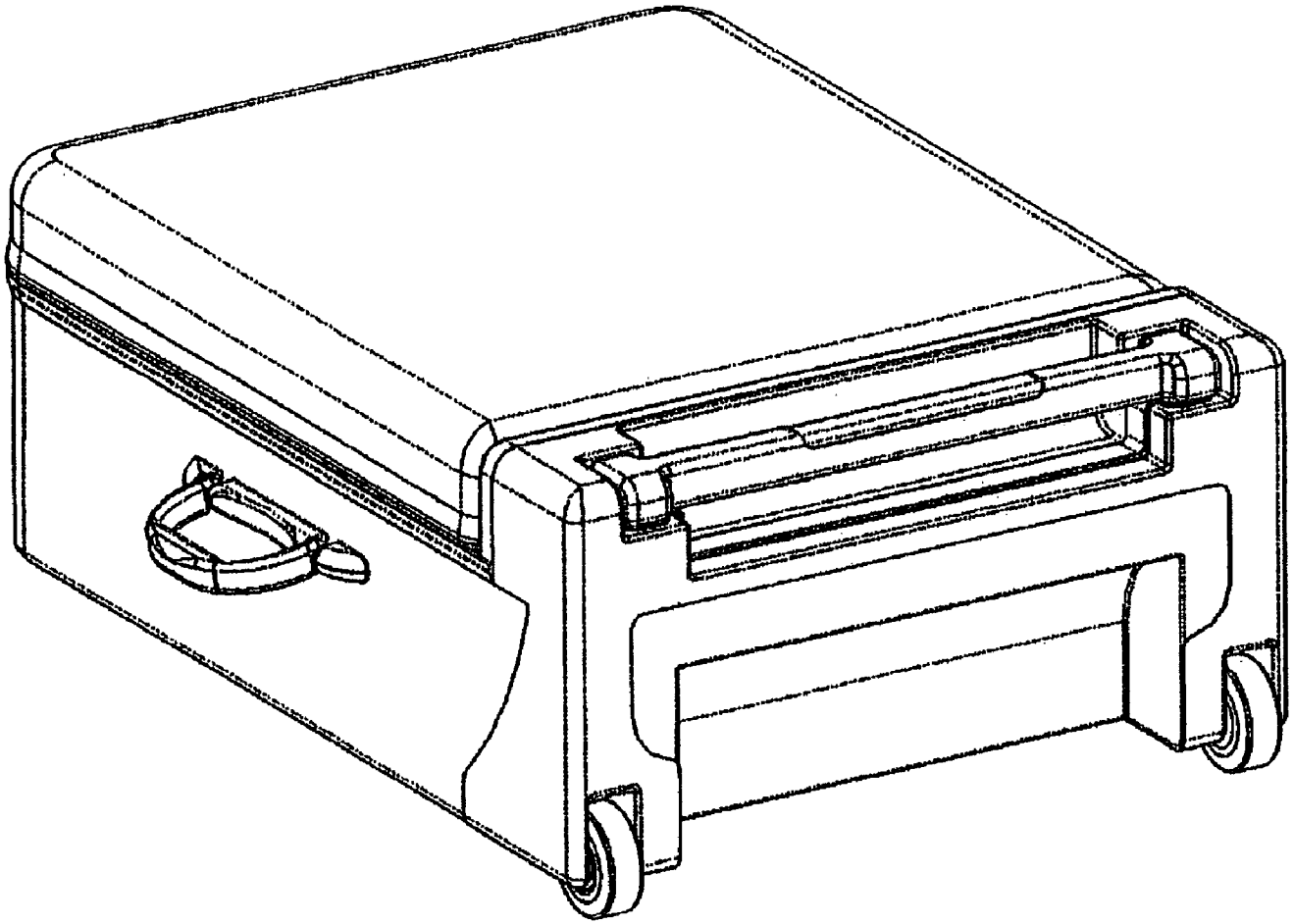
FIGS. 10 to 15 illustrate a further slightly different embodiment of the invention.
Figure 11:
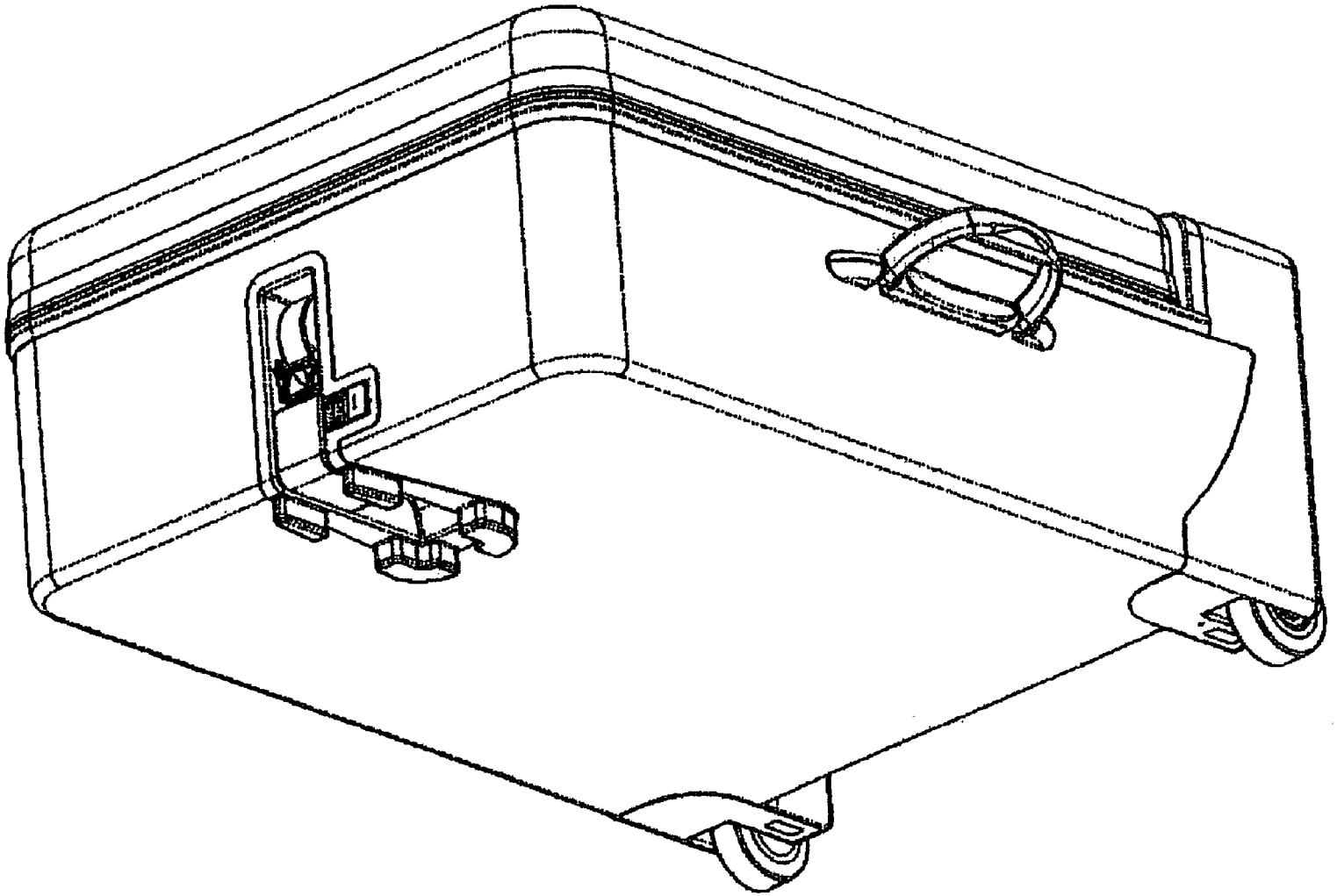
Figure 12:
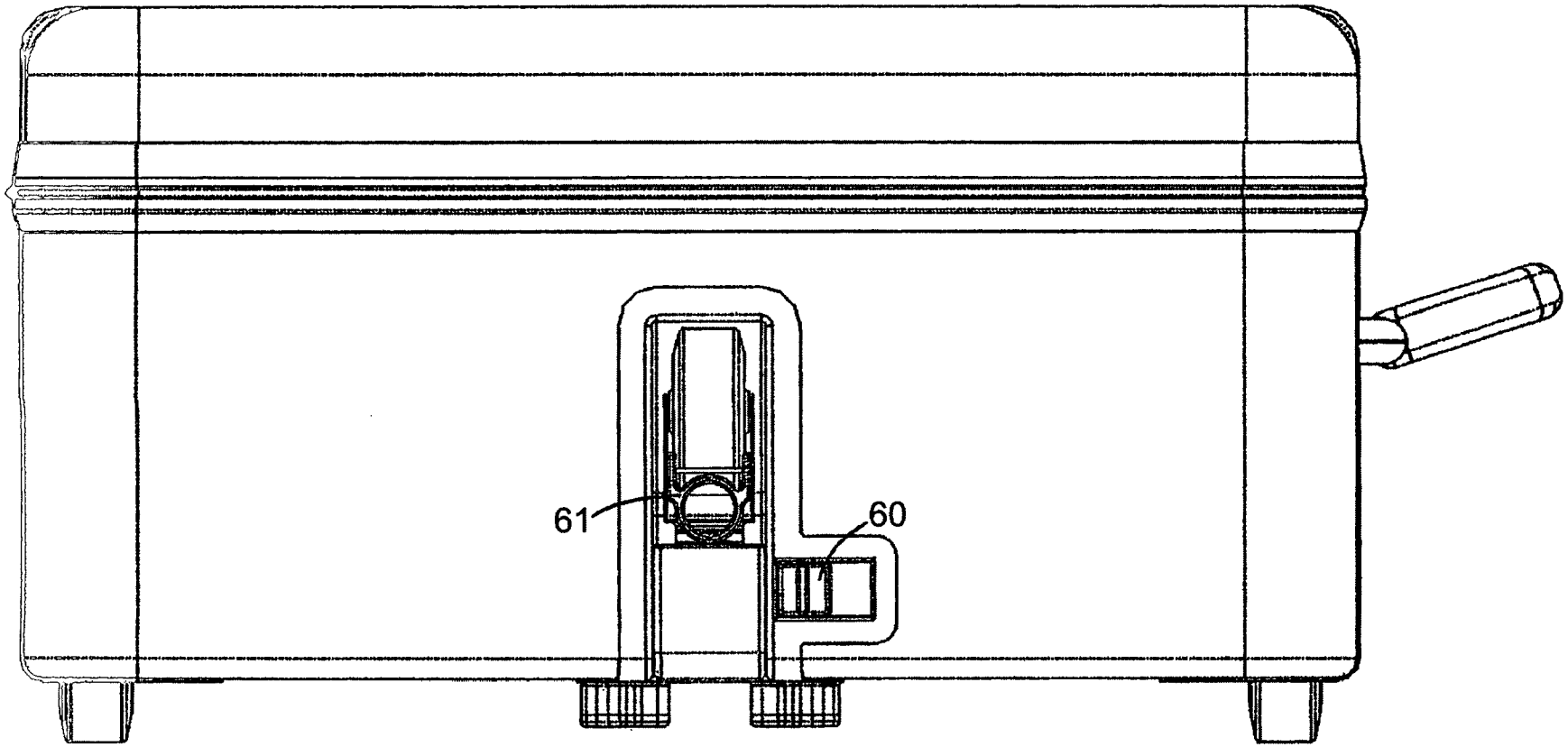
Figure 13:
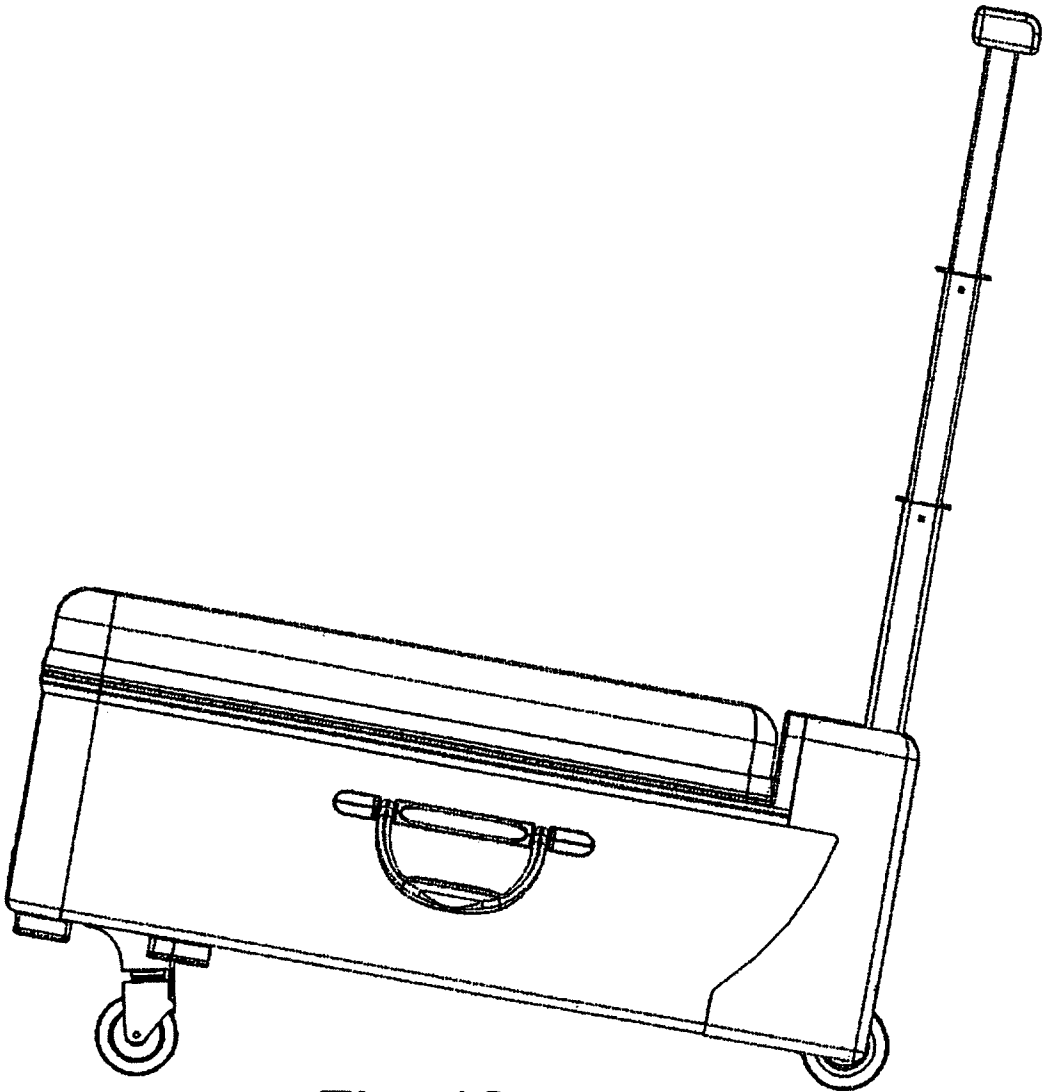
Figure 14:
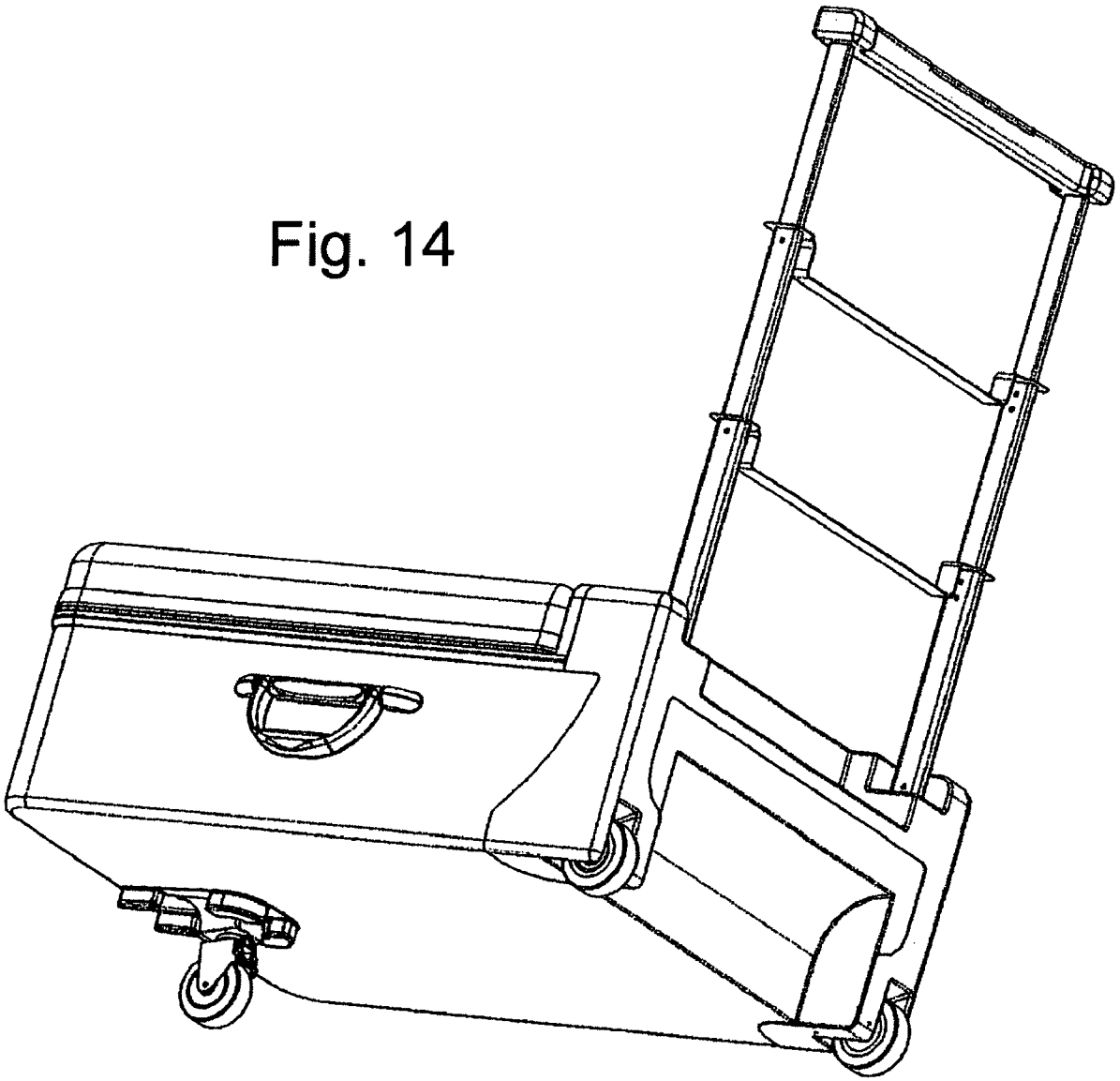
Figure 15:
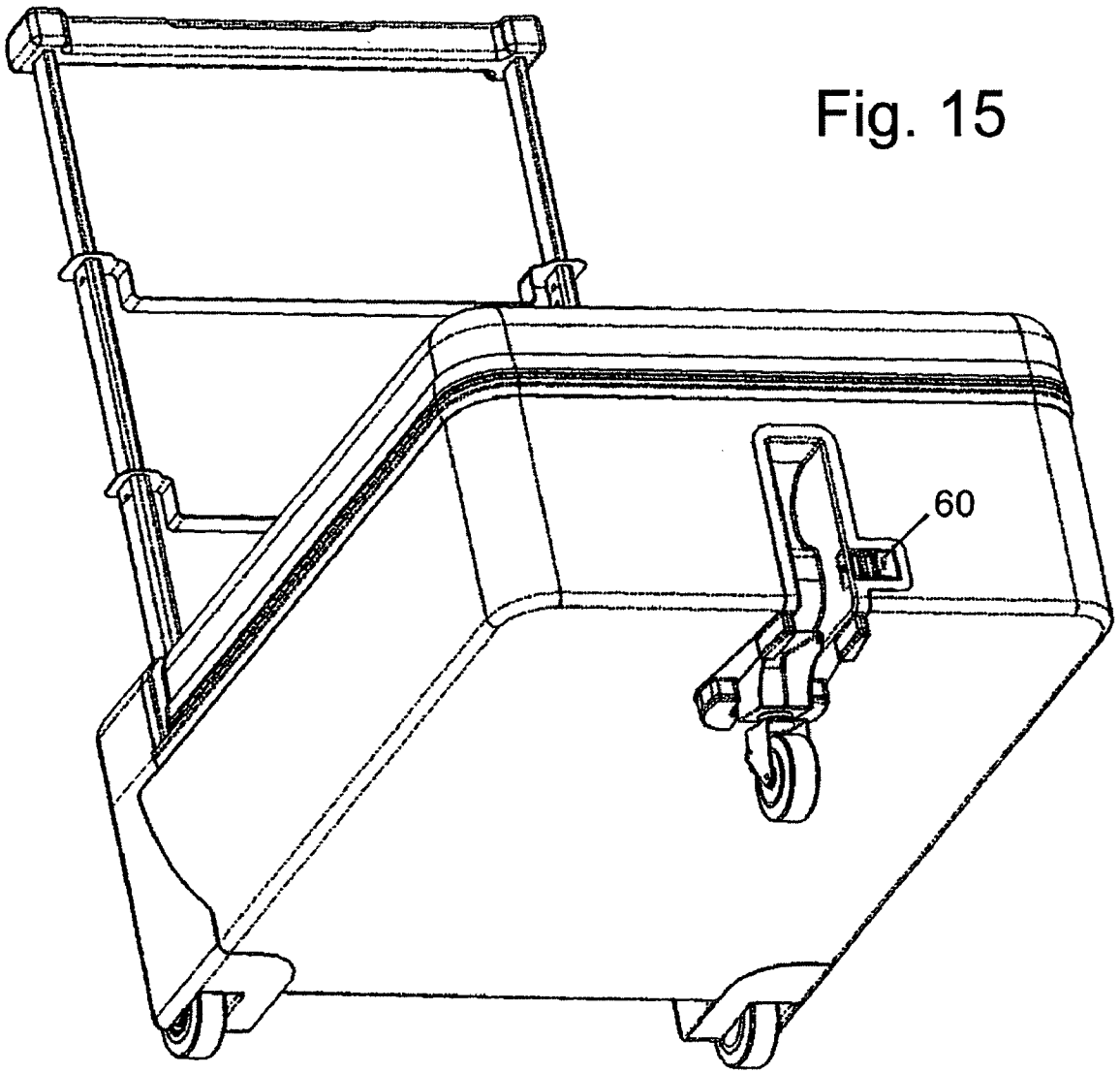
Figure 16:
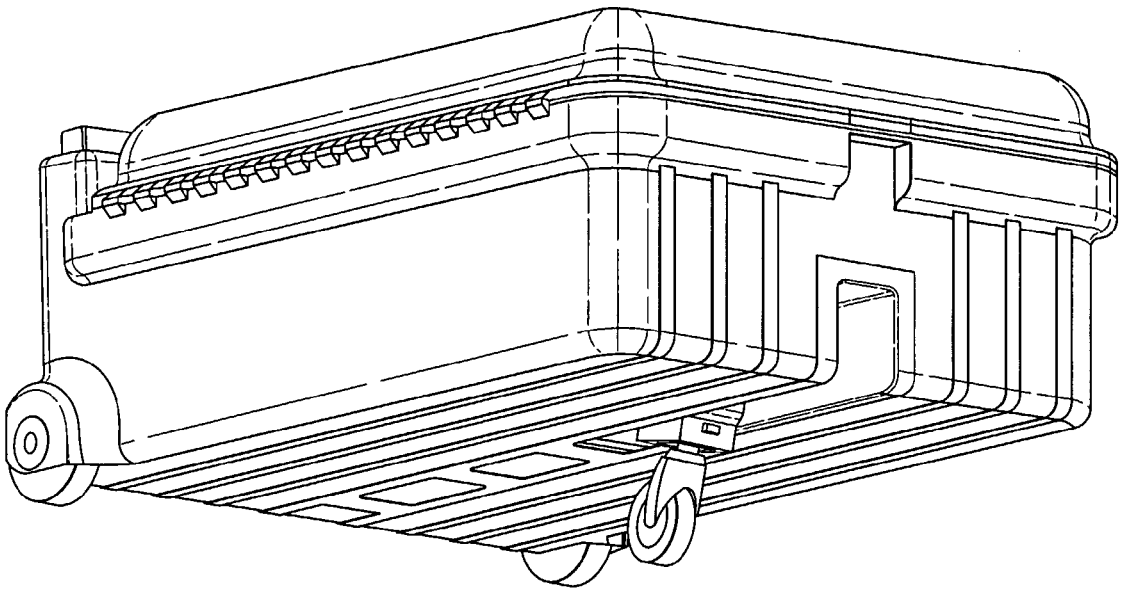
FIGS. 16 to 19 illustrate a yet further embodiment.

FIG. 9 shows an alternative embodiment of the invention which includes a stopper 49 attached to the underside of the base 34 of the luggage receptacle. The stopper could comprise a single, centred, stopper but more preferably a plurality (e.g. 2 or more) positioned so as to support the luggage receptacle in the inactive position. This means that when the steering wheel assembly 33 is in the inactive position the luggage receptacle will rest on the stopper 49 and not the base 34. The stopper 49 is of a size to protrude substantially the same amount from the base as the support wheels which means that the luggage receptacle will be largely level when the steering wheel assembly 33 is in the inactive position. When the steering wheel assembly 33 is in the active position the stopper 49 will not interfere with the movement of the luggage case 30.

The self-supporting and self stabilizing characteristics of the wheeled luggage case make it suitable for transporting an infant in addition to the contents of the case. For this purpose, a child seat may be disposed on top of lid and be secured to the case Alternatively other luggage or items may be placed on top of the case.

It should be appreciated that the invention could equally be used with a plurality of steering wheels, e.g. 1 or more.

Preferably, a simple braking system, known to those skilled in the art, is installed for safety and convenience purposes.

FIGS. 10 to 15 show a slightly different embodiment with modifications to the invention including a quick release latch 60 for releasing the steering wheel for use and a ring handle guide 61 for pulling out and also, suitably, retracting the steering wheel assembly back into the slot recess of the case.

Also, a latch mechanism, here a spring-loaded ball catch lock, of the steering wheel L-frame on to the support surface at the base of the case can be used to prevent detachment during wheel lift-off and an L-shaped steering wheel frame to decrease likelihood of collapse of the steering wheel system, especially during lift-off and when engaging resistance during reversing.

Figure 17:
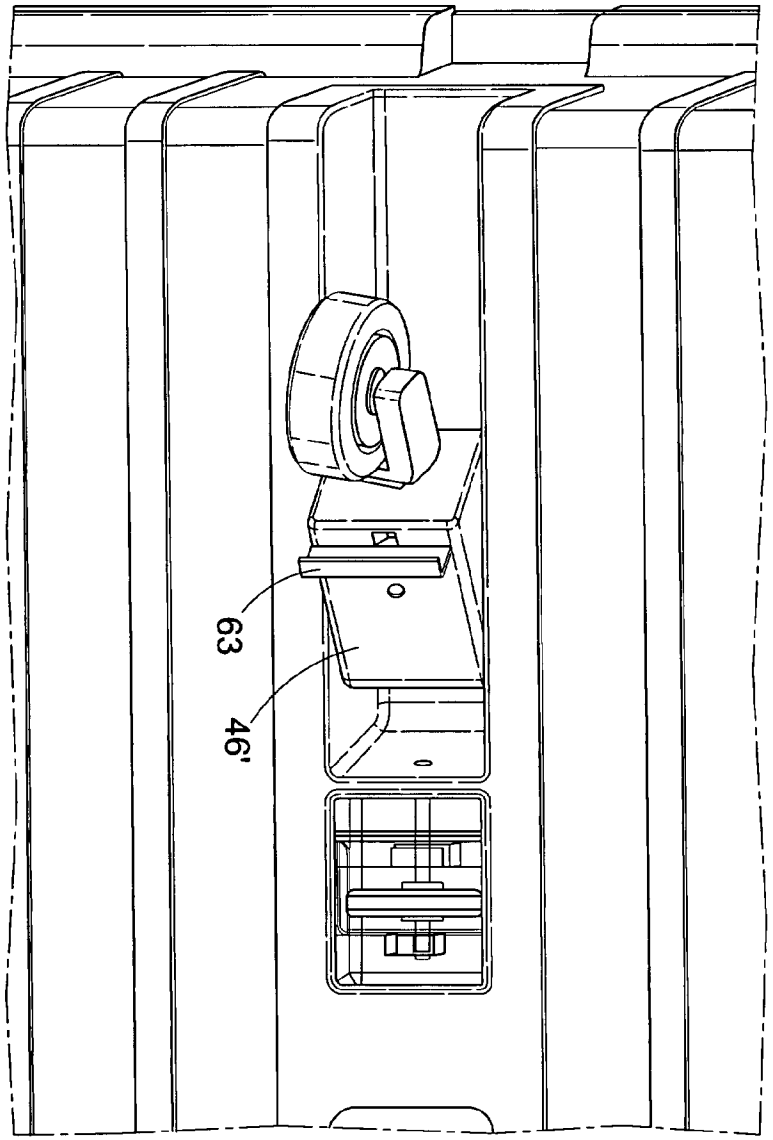
Figure 18:
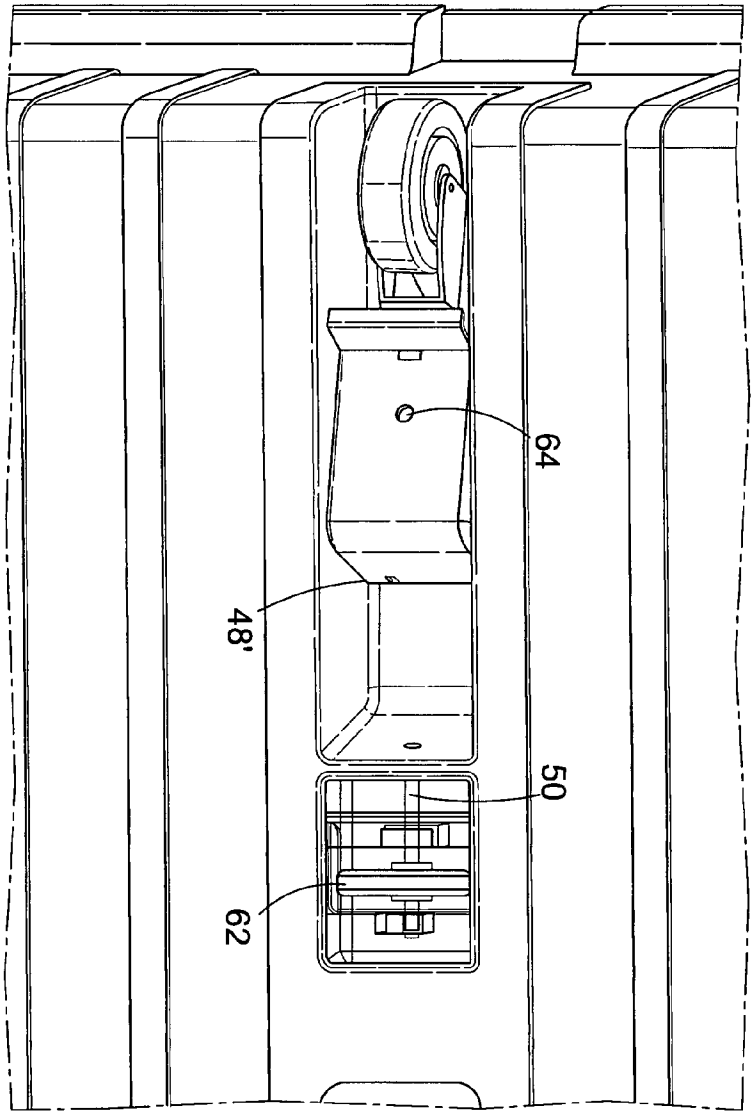
Figure 19:
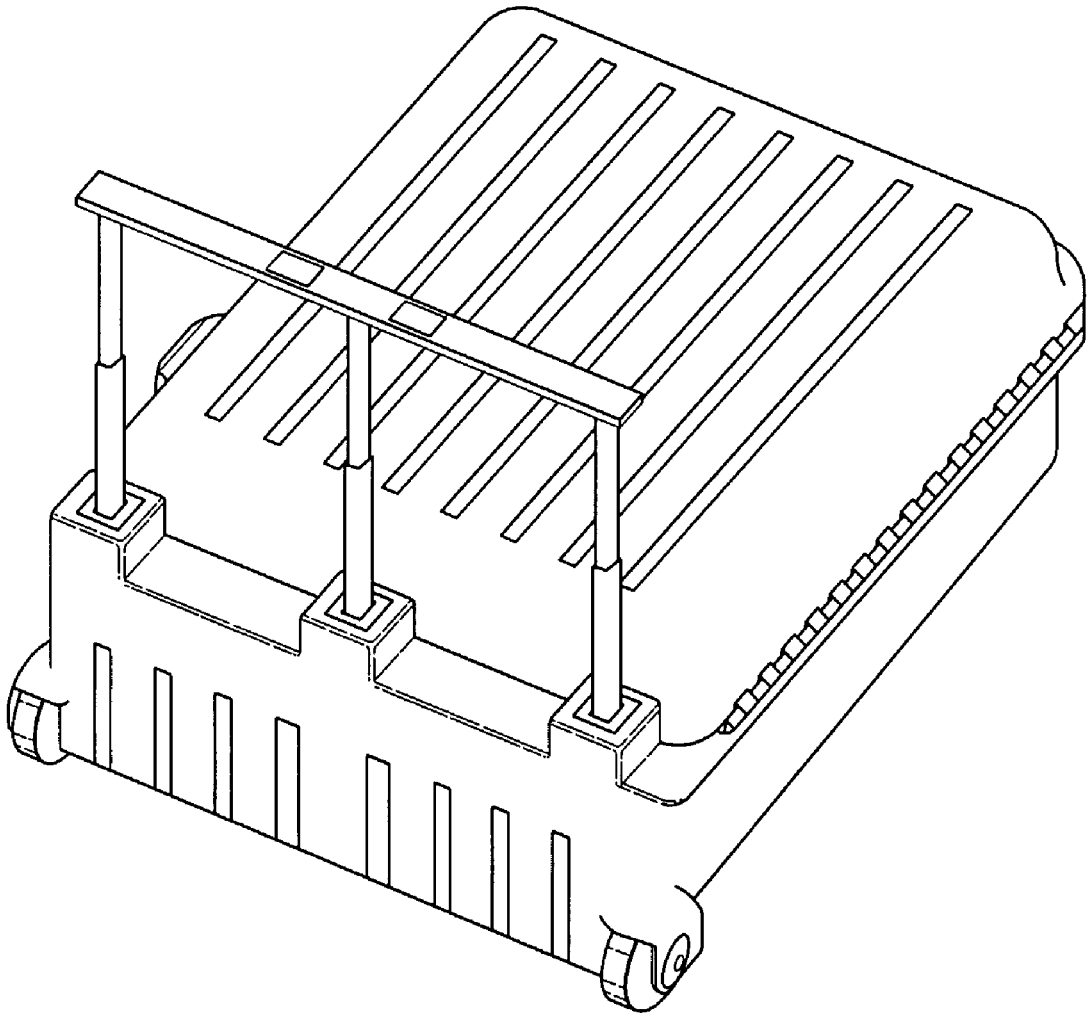

Referring now to FIGS. 16 to 19, this embodiment of the case differs from the preceding embodiment in a number of respects. It will be seen that the case is moulded with reinforcing ribs and from FIG. 19 it will be seen that the handle bar arrangement has three uprights instead of two in order to give even greater strength to the handle. Furthermore, as can be seen from FIGS. 16 to 18, the steering wheel assembly is housed wholly within a recess in the bottom wall of the case and which runs to the end wall but here there is no separate recess in the end wall, i.e. unlike the preceding embodiment the steering wheel assembly does not move from a recess in the end wall to a recess in the bottom wall. Instead, the pivotable castor wheel of the steering wheel assembly in this latest embodiment is generally accommodated in its recessed state lying along the channel shaped recess in the bottom wall and with the wheel in the orientation in which it would be when extended. In FIG. 17, the wheel is seen in a partially extended state and in FIG. 18 it is seen fully retracted into the recess/channel. Thus, extension and retraction of the steering wheel assembly in this embodiment is through a simple single pivoting motion about pivot axis 48' within the channel recess.

A flange 63 on the leading edge of the steering wheel 46' abuts against the bottom wall of the case when the steering wheel assembly is in its extended state and the bracket 46' is releasably locked in its extended position by a bolt 50 that projects into a keep 64 in the bracket 46 and is releasable by a button 62 on the bottom wall of the case. Thus, this embodiment also has a latch mechanism to prevent detachment of the steering wheel assembly when in its operative position and which here is under user control through manual operation of the button 62.

In summary the present invention provides a new design for the large size travel suitcase that is easily portable with minimal effort and is highly manoeuvrable, stable and convenient to use.

The proposed suitcase is a light-weight, robust, trolley-type design with a retractable push handle and retractable wheels (e.g. see FIGS. 4 to 7 inclusive).

The system described herein has a number of advantages over the prior art. These include:

Firstly, the design with a wide base and a low centre of gravity is inherently more stable compared to various traditional suitcase designs. Unlike cases towed on wheels at an incline (e.g. U.S. Pat. No. 5,116,289), this design is self-stabilised and self-supporting during movement.

Secondly, the design is more manoeuvrable. A tricycle wheel configuration, with two unidirectional rear wheels located one at each side and a single multidirectional front wheel, will confer maximum manoeuvrability (see FIG. 8).

Thirdly, a retractable push handle will enable the suitcase to be carried in an upright manner like a conventional case, when the handle and wheels are retracted. With contemporary light-weight and tough aluminium alloys, the retractable handle can be easily manufactured to various design options.

Fourthly, the retractable wheels allows the wheels to come into play only when needed and avoid potential damage of exposed wheels during luggage transfer. Prior U.S. Pat. No. 5,407,039 has multiple retractable wheels that are cumbersome and heavy. We proposed two small light-weight roller blade-like rear wheels that will only come into play when the 'cart' is tilted. A third 'flippable' wheel in the front tilts the case to bring the rear wheels into play and enables the case to function as a cart tricycle (see diagram). This design minimises bulk and weight on the case itself and makes the case practical and convenient to use.

Fifthly, the push-trolley suitcase design is more ergonomically suited for moving large and heavy loads. Furthermore, it is easier to push than to pull a heavy load. This push-trolley suitcase design enables one to cart a heavy suitcase load with more control and with much less effort. Furthermore, this trolley suitcase design can also be adapted for pulling purposes such as reversing from a right corner and reversing down from a step.

Sixthly, the push trolley suitcase design can be used as a push trolley in itself. Other luggage can be piled on top of it and carted around as with the use of an airport or train station push trolley. This is possible with contemporary plastic that is tough, light-weight and strong. Other options include the use of canvass with aluminium skeletal frame reinforcement.

Seventhly, in addition to the push trolley function, the push trolley suitcase can conveniently be converted into a push pram for babies or toddlers with suitable accessorial and safety attachment.

Furthermore, the base of suitcase is at an incline when the retractable wheel is in use. This helps to bring the hind-wheels into play, and shifts the centre of gravity backwards towards the hind-wheels to improve stability on the tricycle and manoeuvrability of the front multidirectional wheel. It also tilts the handle bar backwards to allow for foot clearance when walking and pushing the case and keeps the stacked luggage on the trolley in place.

The L-shape wheel frame design confers stability to all directions of wheel movement, takes up minimal luggage space when retracted and resists compressive forces when in use and requires less material bulk.

It will be appreciated that a retractable steering wheel assembly as illustrated in FIG. 4 and as described above could be employed in a luggage case where the steering wheel assembly and support wheels were of substantially equivalent size. In this case the luggage case would be substantially parallel to the surface on which it was being wheeled.

The invention claimed is:

1. A wheeled luggage case having a luggage receptacle, the receptacle having two opposing major walls and having end walls forming a luggage compartment, the luggage receptacle having a front end and a rear end and having a length and width which both exceed its height, whereof a major wall of the receptacle is adapted to serve as a bottom wall that closely faces the ground during use of the wheels whereby the case may be wheeled along on the bottom wall like a trolley, wherein said luggage case further comprises:

(i) a plurality of unidirectional support wheels located at the rear end of the bottom wall;

(ii) a retractable steering wheel assembly, located on the bottom wall, distanced from the support wheels, said steering wheel assembly having at least one multidirectional wheel and being moveable between an active position at which the wheel assembly extends below the bottom wall of the luggage receptacle or an inactive position at which the wheel assembly is substantially within the profile of the luggage receptacle; and (iii) a handle means that can be moved between an active position at which it extends outwards from the luggage receptacle and can be engaged by a user and an inactive position at which the handle is contained substantially within the luggage, the handle being located at one end of the luggage receptacle for steering, pushing, pulling and lifting purposes wherein the handle is located at the same end of the luggage receptacle as the support wheels when the handle is in the active position, such that, when the steering wheel assembly is in the active position, in use, the steering wheel assembly and support wheels are in contact with the ground and wherein when the luggage receptacle is being pushed along by the handle, the steering wheel assembly leads, wherein the steering wheel assembly and support wheels are configured such that with the steering wheel assembly in its active position, the steering wheel assembly extends further from the bottom wall than the support wheels such that the bottom wall is at an incline with respect to the ground, the bottom wall being inclined upwardly away from the support wheels, such that a greater portion of the forces acting on the luggage receptacle will act through the support wheels than through the steering wheel assembly, wherein the support wheels are non-retractable wheels.

2. A wheeled luggage case according to claim 1 comprising two support wheels and a retractable steering wheel assembly configured relative to each other in a tricycle wheel configuration.

3. A wheeled luggage case as claimed in claim 1, wherein when the steering wheels are retracted, the support wheels are inactivated by a stopper, the stopper protruding from the bottom wall such that when the steering wheel is in the inactive position the luggage case rests on the stopper.

4. A wheeled luggage case as claimed in claim 1, wherein the retractable wheel assembly is pivotally mounted to deploy or retract in a pivoting motion.

5. A wheeled luggage case as claimed in claim 1, wherein the wheel of the steering wheel assembly is pivotally mounted in the assembly such that it can rotate about its own axis and about an axis substantially perpendicular to it.

6. A wheeled luggage case as claimed in claim 1, wherein the steering wheel assembly as deployed is supported by a support surface on the bottom wall of the case.

7. A wheeled luggage case as claimed in claim 1, wherein the case in the active wheeling arrangement can act as a trolley cart to carry other luggage

8. A wheeled luggage case as claimed in claim 1, wherein when the wheeling system is in an inactive arrangement, the base of the case is level to the ground by a stopper at one end and the support wheels at the other.

9. A wheeled luggage case as claimed in claim 1, wherein the posterior surface of the case is recessed to provide additional striding space.

10. A wheeled luggage case as claimed in claim 1, wherein the case is adapted to be wheeled along on said bottom wall like a trolley.

11. A wheeled luggage case as claimed in claim 1, wherein the bottom wall is inclined upwardly away from the support wheels such that the luggage receptacle's weight is displaced away from the steering wheel assembly.

12. A wheel luggage case as claimed in claim 1, wherein the wheel of the steering wheel assembly is connected to a bracket, the bracket being connected to a turning element which can pivot about a substantially vertical axis in use in order to self adjust to turns in the path of the luggage case, the luggage receptacle having a recess to receive the steering wheel assembly when the steering wheel assembly is in the inactive position, wherein when the steering wheel assembly is in the inactive position the turning element is perpendicular to the direction of forward linear motion of the luggage case in use.

13. A wheeled luggage case as claimed in claim 4, wherein the luggage receptacle incorporates exterior recesses in both an end wall and the bottom wall adapted to accommodate the steering wheel assembly in the inactive and active positions respectively, the steering wheel assembly moving pivotally from the end wall recess to the bottom wall recess to be in its active position.

14. A wheeled luggage case as claimed in claim 4, wherein the luggage receptacle incorporates an exterior recess in the bottom wall adapted to accommodate the steering wheel assembly in the inactive position.

15. A wheeled luggage case as claimed in claim 4, wherein the steering wheel assembly is pivotally mounted to the case, about a pivot, in a configuration whereby the weight of the luggage case is not borne via the pivot of the pivotal mounting of the steering wheel assembly to the luggage case.

16. A wheeled luggage case as claimed in claim 15, wherein the steering wheel assembly has an L-shaped frame or bracket by means of which the assembly is pivotally mounted to the case and whereby an arm of the L-shaped frame or bracket serves to transmit the majority or all of the weight forces that are borne by the steering wheel assembly between the luggage case and the steering wheel and bypassing the pivot of the pivotal mounting of the L-shaped frame or bracket to the case.

17. A wheeled luggage case as claimed in claim 6 wherein the support surface is recessed into the base wall of the case.

18. A wheeled luggage case as claimed in claim 17 wherein the support surface for the wheel assembly in the base wall is located at an acute angle to the base wall of the case with respect to a line between the front of the case and the support wheels.

19. A wheeled luggage case having a luggage receptacle, the receptacle having two opposing major walls and having end walls forming a luggage compartment, the luggage receptacle having a front end and a rear end and having a length and width which both exceed its height, whereof a major wall of the receptacle is adapted to serve as a bottom wall that closely faces the ground during use of the wheels whereby the case may be wheeled along on the bottom wall like a trolley, wherein said luggage case further comprises:

(i) a plurality of unidirectional support wheels located at the rear end of the bottom wall;

(ii) a single retractable steering wheel assembly, located on the bottom wall, distanced from the support wheels, said steering wheel assembly having at least one multidirectional wheel and being moveable between an active position at which the wheel assembly extends below the bottom wall of the luggage receptacle or an inactive position at which the wheel assembly is substantially within the profile of the luggage receptacle; and (iii) a handle means that can be moved between an active position at which it extends outwards from the luggage receptacle and can be engaged by a user and an inactive position at which the handle is contained substantially within the luggage, the handle being located at one end of the luggage receptacle for steering, pushing, pulling and lifting purposes wherein the handle is located at the same end of the luggage receptacle as the support wheels when the handle is in the active position, such that, when the steering wheel assembly is in the active position, in use, the steering wheel assembly and support wheels are in contact with the ground and wherein when the luggage receptacle is being pushed along by the handle the steering wheel assembly leads, wherein the steering wheel assembly and support wheels are configured such that with the steering wheel assembly in its active position, the steering wheel assembly extends further from the bottom wall than the support wheels such that the bottom wall is at an incline with respect to the ground, the bottom wall being inclined upwardly away from the support wheels, such that a greater portion of the forces acting on the luggage receptacle will act through the support wheels than through the steering wheel assembly, wherein the support wheels are non-retractable wheels.

20. A wheeled luggage case having a luggage receptacle, the receptacle having two opposing major walls and having end walls forming a luggage compartment, the luggage receptacle having a front end and a rear end and having a length and width which both exceed its height, whereof a major wall of the receptacle is adapted to serve as a bottom wall that closely faces the ground during use of the wheels whereby the case may be wheeled along on the bottom wall like a trolley, wherein said luggage case further comprises:

(i) a plurality of unidirectional support wheels located at the rear end of the bottom wall;

(ii) a retractable steering wheel assembly, located on the bottom wall, distanced from the support wheels, said steering wheel assembly being connected to the bottom wall by a holding bracket in use, the steering wheel assembly having at least one multidirectional wheel and being moveable between an active position at which the wheel assembly extends below the bottom wall of the luggage receptacle or an inactive position at which the steering wheel assembly and holding bracket are within the profile of the luggage receptacle; and (iii) a handle means that can be moved between an active position at which it extends outwards from the luggage receptacle and can be engaged by a user and an inactive position at which the handle is contained substantially within the luggage, the handle being located at one end of the luggage receptacle for steering, pushing, pulling and lifting purposes wherein the handle is located at the same end of the luggage receptacle as the support wheels when the handle is in the active position, such that, when the steering wheel assembly is in the active position, in use, the steering wheel assembly and support wheels are in contact with the ground and wherein when the luggage receptacle is being pushed along by the handle the steering wheel assembly leads, wherein the steering wheel assembly and support wheels are configured such that with the steering wheel assembly in its active position, the steering wheel assembly extends further from the bottom wall than the support wheels such that the bottom wall is at an incline with respect to the ground, the bottom wall being inclined upwardly away from the support wheels, such that a greater portion of the forces acting on the luggage receptacle will act through the support wheels than through the steering wheel assembly, wherein the support wheels are non-retractable wheels.

21. A wheeled luggage case as claimed in claim 20, wherein the luggage receptacle incorporates an exterior recess to accommodate the steering wheel assembly in the inactive positions respectively, wherein the steering wheel assembly is housed wholly within a recess when the steering wheel assembly is in the inactive position and the recess provides lateral support to the holding bracket when the steering wheel assembly is in the active position.

* * * * *